US005762743A

United States Patent [19]

Nakamura

[11] Patent Number: 5,762,743

[45] Date of Patent: Jun. 9, 1998

[54] IMAGE FORMING KIT AND IMAGE RECEIVING SHEET

[75] Inventor: Hideyuki Nakamura, Shizuoka, Japan

[73] Assignee: Fuji Photo Film Co., Ltd., Kanagawa, Japan

[21] Appl. No.: 647,624

[22] Filed: May 15, 1996

[30] Foreign Application Priority Data

May 15, 1995 [JP] Japan ..... 7-115696

[51] Int. Cl.[6] ..... B41M 5/26; B41M 5/34

[52] U.S. Cl. ..... 156/235; 428/195; 428/447; 428/500; 428/522; 428/913; 428/914; 503/227

[58] Field of Search ..... 8/471; 156/235; 428/195, 447, 500, 522, 913, 914; 503/227

[56] References Cited

U.S. PATENT DOCUMENTS 5,006,502 4/1991 Fujimura et al. ..... 503/227

*Primary Examiner*—Bruce H. Hess

*Attorney, Agent, or Firm*—Birch, Stewart, Kolasch & Birch, LLP

[57] ABSTRACT

An image forming kit is composed of one or more ink sheets and an image receiving sheet. The ink sheet is composed of a support sheet and an ink layer of 0.2–1.0 μm thick composed of 30 to 70 weight parts of a particulate pigment and 25 to 60 weight parts of an amorphous polymer having a softening point of 40°–50° C. The image-receiving sheet is composed of a support sheet, an intermediate layer and an image-receiving layer. The intermediate layer is composed of a polymer and a fluorine atom-containing anionic surfactant.

10 Claims, No Drawings

IMAGE FORMING KIT AND IMAGE RECEIVING SHEET

FIELD OF THE INVENTION

This invention relates to an image forming kit and an image receiving sheet. The invention further relates to a process for preparing a multi-color image using the image forming kit.

BACKGROUND OF THE INVENTION

Heretofore, there have been known two thermal transfer recording methods for the preparation of a multi-color image which utilize a thermal head printer or a laser beam printer, that is, a sublimation dye transfer recording method and a fused ink transfer recording method. The sublimation dye transfer method is appropriately employed for forming a photographic image but is not suitable for the production of a clear and sharp image which is analogous to a multi-color image produced in printing art.

The fused ink transfer recording method comprises the steps of superposing on an image receiving sheet an ink sheet having a support and a thermally fusible ink layer which crises a coloring matter (e.g., pigment or dye) and a binder (e.g., wax) and imagewise heating the support of the ink sheet to postionwise fuse the ink layer to form and transfer an image of fused ink onto the image receiving sheet. A multi-color image can be prepared using a number of color ink sheets. The fused ink transfer recording method is advantageous in the sensitivity, cost, and endurance of the formed image, as compared with the sublimation dye transfer recording method. It, however, has a drawback in that the color image prepared by the fused ink transfer recording method is poor in its quality, as compared with the sublimation dye transfer recording method. This is because the fused ink transfer recording method does not utilize gradation recording but utilizes binary (i.e. two valued) recording.

There have been proposed a number of improvements on the composition of the ink material of the ink sheet to enable the gradation recording by the use of the fused ink transfer recording method. The basic concept of the heretofore reported improvement resides in portionwise (or locally) controlling the amount of the ink to be transferred onto the image receiving sheet. In more detail, under heating by the thermal head, the viscosity of the ink layer at the site in contact with the thermal head lowers and tends to adhere to the image receiving sheets whereby the transfer of the ink takes place. In this process, the amount of the ink to be transferred can be controlled by varying elevation of temperature on the thermal head so that the cohesive failure in the ink layer is varied under control hereby varying the gamma characteristic of the transferred image. Thus, the optical density of the transferred ink image is portionwise varied, and accordingly, an ink image having gradation is formed. However, the gradation priced by thus modified fused ink transfer recording method is still inferior to that produced by the sublimation dye transfer recording method. Moreover, the optical density of a fine line produced by the modified fused ink transfer recording method is not satisfactory.

Further, the fused ink transfer recording methods of prior art have other disadvantageous features such as low resolution and poor fixation of the transferred ink image. This is because the ink layer generally uses crystalline wax having a low melting point as the binder, and the wax tends to spread on the receiving sheet in the process of transfer under heating. Furthermore, the crystalline wax scarcely gives a transparent image due to light scattering on the crystalline phase. The difficulty in giving a transparent image causes serious problems in the production of a multi-color image which is formed by superposing a yellow color image, a magenta color image, and a color cyan image.

EP-A-649 754-A1 (published on Apr. 26, 1995) discloses a heat sensitive ink sheet which comprises a support sheet and a transparent heat sensitive ink layer having a thickness of 0.2 to 1.0 μm which is formed of a heat sensitive irk material comprising 30 to 70 weight parts of a colored pigment at least 70 weight % of which has a particle size of not more than 1.0 μm and 25 to 60 weight parts of amorphous organic polymer having a softening point of 40° to 150° C., and discloses a method for thermal transfer recording of a multi-color image using the heat sensitive ink sheet and an image receiving sheet. A multi-color image formed on the image receiving sheet (which is composed of a support sheet and a single image-receiving layer) by portionwise transfer of the ink layers from the ink sheets is then transferred together with the image-receiving layer onto a final image support for checking or observing the formed multi-color image. This heat sensitive ink sheet is favorably employable for forming a multi-gradation multi-color image according to area gradation (i.e., binary gradation or binary recording) and has the following advantageous features:

1) each color image has an enough reflection density;
2) the ink material is appropriate for giving high resolution;
3) the partitioned area (e.g., line or dot) of the formed image has high edge sharpness;
4) the optical density of the partitioned area is uniform regardless of size of the partitioned area (such as dots or lines);
5) the transferred ink layer has high transparency;
6) the recording material has high sensitivity;
7) the formed image has fixation strength; and
8) the formed color image shows good color reproduction of the original color image.

According to the study by the present inventor, however, it has been noted that unevenness of image or missing image area is sometimes observed on the multi-color image transferred on a final image support such as an ordinary paper, a synthetic paper, a plastic film, or a paper coated with a white pigment. His further study has revealed that such problem can be obviated by providing a double image-receiving layer (or a combination of a upper image-receiving layer and a lower intermediate layer having cushioning property) onto the image receiving layer. However, the provision of the double image-receiving layer brings about another problem in that some troubles take place in the transfer of the ink image and upper image-receiving layer onto the final image support. For instance, due to high bonding strength between the upper image-receiving layer and the lower intermediate layer, all or a portion of the formed image and the image-receiving layer is not transferred onto the final image support, or the lower intermediate layer (i.e., cushioning layer) is also transferred onto the final image support. Such problems disturb formation of a multi-color image of high quality on the final image support. Particularly, such problems are detrimental for the production of a color proof which is used for checking a print image in advance.

SUMMARY OF THE INVENTION

The present invention has an object to pride a new image formation kit which is advantageously employable for production of a multi-color, multi-gradation image according to area gradation.

The invention has a specific object to provide a new image formation kit which is favorably employable for production of a color proof having multi-color, multi-gradation image.

The invention also has an object to provide a new image receiving sheet which is advantageously employable in combination with a known ink sheet for the formation of a multi-color image according to image transfer method.

The invention further has an object to provide an multi-color, multi-gradation image formation process utilizing the above-mentioned new image formation kit.

There is provided by the invention an image forming kit comprising an ink sheet and an image receiving sheet, wherein the ink sheet comprises a support sheet and an ink layer of 0.2 to 1.0 μm thick comprising 30 to 70 weight parts of a particulate pigment and 25 to 60 weight parts of an amorphous polymer having a softening point of 40° to 150° C., and the image receiving sheet comprises a support sheet, an intermediate layer (i.e., cushioning layer), and an image-receiving layer, said intermediate layer comprising a polymer and a fluorine atom-containing anionic surfactant.

The invention further provides an image receiving sheet comprising a support sheet, an intermediate layer and an image-receiving layer, in which the intermediate layer comprises a polymer and a fluorine atom-containing anionic surfactant.

The image formation kit and the image receiving sheet of the invention can be favorably employed in the following image formation process.

A process for preparing a multi-color image on a final image support sheet which comprises the steps of:

1) placing an ink sheet which comprises a support sheet and an ink layer of 0.2 to 1.0 μm thick comprising 30 to 70 weight parts of a colored particulate pigment and 25 to 60 weight parts of an amorphous polymer having a softened point of 40° to 150° C. on an image receiving sheet which comprises a support sheet, an intermediate layer comprising a polymer and a fluorine atom-containing anionic surfactant, to give an image forming composite comprising the ink sheet and the image-receiving sheet;
2) imagewise heating the image forming composite;
3) removing the support sheet of the ink sheet from the image-receiving sheet leaving an ink image on the image-receiving layer;
4) placing another ink sheet which comprises a support sheet and an ink layer of 0.2 to 1.0 μm thick comprising 30 to 70 weight parts of a colored particulate pigment of another color and 25 to 60 weight parts of an amorphous polymer having a softening point of 40° to 150° C. on the ink image left on the image-receiving layer in the step 3) above, to give another image forming composite;
5) imagewise heating the image forming composite given in the step 4) above;
6) removing the support sheet of the ink sheet from the image receiving sheet leaving another ink image on the image-receiving layer;
7) repeating once or twice the steps 4) through 6) using one or two ink sheets having pigments of different colors, so as to form three or four ink images in total on the image-receiving layer of the receiving sheet;
8) combining the image-receiving sheet which has three or four ink images on its image receiving sheet, with the final image support in such manner that the ink images of the image receiving sheet are placed on the final image support; and
9) removing the support sheet of image receiving sheet together with the intermediate layer from the final image support leaving both the image-receiving layer and the multi-color ink image on the final image sheet.

DETAILED DESCRIPTION OF THE INVENTION

[Ink Sheet]

The ink sheet, which is heat-sensitive, preferably employed in the invention is described in the aforementioned EP-A-649 754-A1.

The heat-sensitive ink sheet has a support sheet and an essentially transparent heat-sensitive ink layer having a thickness of 0.2 to 1.0 μm, preferably 0.2 to 0.8 μm, more preferably 0.3 to 0.6 μm, which is formed of a heat sensitive ink material comprising 30 to 70 weight parts of a colored pigment, preferably at least 70 weight % of which has a particle size of not more than 1.0 μm, or not more than the thickness of the ink layer, and 25 to 60 weight parts of amorphous organic polymer had a softening point of 40° to 150° C. (preferably 65° to 130° C.).

As the support sheet, any of the materials of the support sheets employ in the conventional fused ink transfer system and sublimation ink transfer system can be employed. Preferably employed is a polyester film of 2 to 20 μm thick, specifically approx. 5 μm thick, which has been subjected to release treatment.

The pigment to be incorporated and dispersed in the heat-sensitive ink layer can be optionally selected from known pigments. Examples of the know pigments include carbon black, azo-type pigment, phthalocynine-type pigment, qunacridone-type pigment, isoindoline-type pigment, anthraquinone-type pigment, and isoindoline-type pigment. These pigments can be employed in combination with each other. A known dye can be employed in combination with the pigment for controlling hue of the color image.

Any of amorphous organic polymers having a softening point of 40° to 150° C. can be employed for the preparation of the ink layer of the heat-sensitive ink sheet. Example of the employable amorphous organic polymers include butyral resin, polyamide resin, polyethyleneimine resin, sulfonamide resin, polyester-polyol resin, petroleum resin, homopolymers and copolymers of styrene or its derivatives (e.g., styrene, vinyltoluene, α-methylstyrene, 2-methylstyrene, chlorostyrene, vinylbenzoic acid, sodium vinylbenzenesulfonate and aninostyrene), and homopolymers and copolymers of methacrylic acid or its ester (e.g., methacrylic acid, methyl methacrylate, ethyl methacrylate, butyl methacrylate, and hydroxyethyl methacrylate), homopolymers and copolymers of acrylic acid or its ester (e.g., acrylic acid, methyl acrylate, ethyl acrylate, butyl acrylate, and α-ethylhexyl acrylate), homopolymers and copolymers of a diene compound (e.g., butadiene and isoprene), and homopolymers and copolymers of other vinyl monomers (e.g., acrylonitrile, vinyl ether, maleic acid, maleic acid ester, maleic anhydride, cinnamic acid, vinyl chloride, and vinyl acetate). These resins and polymers can be employed in combination. Particularly preferred are polyvinyl butyral resin and styrene-maleic acid half ester resin, from the viewpoint of good dispersability of the pigment.

The ink layer can further contain 1 to 20 weight % of additives such as a releasing agent and/or a softening agent based on the total amount of the ink layer so as to facilitate release of the ink layer from the support when the thermal printing (image forming) takes place and increase heat-sensitivity of the ink layer. Examples of the additives include a fatty acid (e.g., palmitic acid and stearic acid), a metal salt of a fatty acid (e.g., zinc stearate), a fatty acid derivative (e.g., fatty acid ester, its partial saponification product, and fatty acid amid), a higher alcohol, a polyol derivative (e.g., ester of polyol), wax (e.g., paraffin wax, carnauba wax, montan wax, bees wax, Japan wax, and candelilla wax), low molecular weight polyolefin (e.g., polyethylene, polypropylene, and polybutyrene) having a viscosity mean molecular weight of approx. 1,000 to 10,000, low molecular weight copolymer of olefin (specifically α-olefin) with organic acid (e.g., maleic anhydride, acrylic acid, and methacrylic acid) or vinyl acetate, low molecular weight oxidized polyolefin, halogenated polyolefin, homopolymer of acrylate or methacrylate (e.g., methacrylate having a long alkyl chain such as lauryl methacrylate and stearyl methacrylate, and acrylate having a perfluoro group), copolymer of acrylate or methacrylate with vinyl monomer (e.g., styrene), low molecular weight silicone resin and silicone modified organic material (e.g., polydimethyl-siloxane and polydiphenylsiloxane), cationic surfactant (e.g., ammonium salt having a long aliphatic chain group, and pyridinium salt), anionic and nonionic surfactants having a long aliphatic chain group, and perfluoro-type surfactant.

The heat-sensitive ink layer preferably shows an optical density (in terms of reflection density) of not less than 1.0 when it is transferred onto a white paper sheet after heating.

In order to prepare an image of appropriate reflection density using an extremely thin ink layer, the ink material preferably comprise 30 to 70 weight parts of a colored pigment, 25 to 60 weight parts of the amorphous organic polymer, and optionally less than 15 weight parts of an additive such as a releasing agent and/or a film softening agent.

The heat-sensitive ink layer mainly comprises the pigment and the amorphous organic polymer, and the amount of the pigment in the layer is high, as compared with the amount of the pigment in the conventional ink lay using a wax binder. Therefore, the ink layer of the invention shows a viscosity of higher than $10^4$ cps at 150° C. (highest thermal transfer temperature), wile the conventional ink layer shows a viscosity of $10^2$ to $10^3$ cps at the same temperature. Accordingly, when the ink layer is heated, the ink layer per se is easily peeled from the support and transferred onto an image receiving layer keeping the predetermined reflection density. Such peeling type transfer of the extremely thin ink layer enables to give an image having a high resolution, a wide gradation from a shadow portion to a highlight portion, and satisfactory edge sharpness. Further, the complete transfer (100%) of ink image onto the image receiving sheet gives desired uniform reflection density even in a small area such as characters of 4 point and a large area such as a solid portion.

[Image Receiving Sheet]

The image receiving sheet of the invention comprises a support sheet, an intermediate layer (i.e., cushioning layer) and an image-receiving layer, in which the intermediate layer comprises a polymer and a fluorine atom-containing anionic surfactant.

The support can be a resin-coated paper sheet or a resin film. The resin film can be made of polyolefin such as polyethylene or polypropylene, polyhalogenated vinyl such as polyvinyl chloride or polyvinylidene chloride, cellulose derivative such as cellulose acetate or nitrocellulose, polyamide, polystyrene, polycarbonate, or polyimide. Most preferred is a biaxially extended polyethylene terepthalate film. The support can be processed on its surface in advance, for facilitating the provision of the intermediate layer or increasing adhesion between the support and the intermediate layer. The processing can be made by corona discharge treatment or glow discharge treatment. Otherwise, a subbing layer can be formed on the surface of the support. For instance, a subbing layer comprising a silane coupling agent can be preferably provided.

On the support, the intermediate layer (or cushioning layer) is provided. The intermediate layer can be a single layer or may comprise two or more layers.

The intermediate layer of the image receiving sheet of the invention comprises a polymer and a fluorine atom-containing anionic surfactant. The intermediate layer preferably has a low Young's modulus value such as in the range of 10 kg·f/cm$^2$ to 10,000 kg·f/cm$^2$, more preferably 10 kg·f/cm$^2$ to 200 kg·f/cm$^2$.

The intermediate layer preferably has a thickness in the range of 1 to 50 μm, more preferably 5 to 30 μm.

The polymer of the intermediate layer can be polyolefin such as polyethylene or polypropylene, ethylene copolymer such as copolymer of ethylene and vinyl acetate or copolymer of ethylene and acrylate ester, polyvinyl chloride, vinyl chloride copolymer, polyvinylidene chloride, vinylidene copolymer, poly(meth)acrylate, polyamide such as copolymerized polyamide or N-alkoxymethylated polyamide, synthetic rubber, or chlorinated rubber. Most preferred is a vinxyl chloride copolymer such as vinyl chloride/vinyl acetate copolymer, a vinyl chloride/vinyl alcohol copolymer, a vinyl chloride/vinyl acetate/ maleic acid copolymer, a vinyl chloride/vinyl acetate/ vinyl alcohol copolymer, or a vinyl chloride/vinyl acetate/hydroxyalkyl acrylate. The vinyl chloride copolymer preferably has a polymerization degree of 200 to 2,000. The vinyl chloride copolymer having such polymerization degree is advantageous because of the following reasons: (1) almost no adhesion takes place at room temperature, (2) elasticity is relatively low, so that it readily follows the unevenness of the multi-color image to transfer the image under uniform condition, (3) it is compatible with a variety of plasticizers so that its elasticity is easily adjusted, and (4) it has a hydroxyl group and/or a carboxyl group, and the fluorine atom-containing anionic surfactant can be easily kept in the intermediate layer.

Examples of the fluorine atom-containing anionic surfactants include a perfluoroalkylsulfonate, a perfluoroalkylphoshate, a perfluoroalkylcarboxylate, a perfluoroalkylaminosulfonate, and an ester thereof. Preferred are of sulfonate type or phosphate type. Most preferred is a fluorine atom-containing sulfonate surfactant having sulfonate group ($—SO_3Na^+$). These fluorine atom-containing anionic surfactants incorporated into the intermediate layer are employed to smoothly release the upper image-receiving-layer when it is transferred together with the ink image onto a final image support, while keeping the image-receiving layer on the intermediate layer before the image receiving sheet is processed for the image transfer.

Other known fluorine atom-containing surfactants such as fluorine atom-containing nonionic surfactants and fluorine atom-containing cationic surfactants or known surfactants of other types are not satisfactorily employable for the purpose of the invention.

The intermediate layer can further contain various polymers, plasticizers, other surfactants, and releasing agents to improve the image receiving layer-releasing performance. A small amount of a tacky polymer can be incorporated into the intermediate layer, so long as tackiness of the intermediate layer at room temperature is kept low. When the vinyl chloride copolymer is employed as the polymer of the intermediate layer, known stabilizers such as of butyltin type or octyltin type can be incorporated. An acrylic rubber or a linear polyurethane can be also incorporated into the intermediate layer as an auxiliary binder.

The plasticizers can be polyester plasticizers such as of adipic acid type, phthalic acid type, sabbatic acid type, epoxy type, trimellitic acid type, pyromellitic acid type, citric acid type, polyfunctional (meth)acrylate monomers such as the below-illustrated six functional acrylate monomers or dimethacrylates, and urethane oligomers such as polymerization products of isocyanate and polyether diol and polyester diol, aromatic urethane acrylate oligomers, and aliphatic urethane acrylate oligomers.

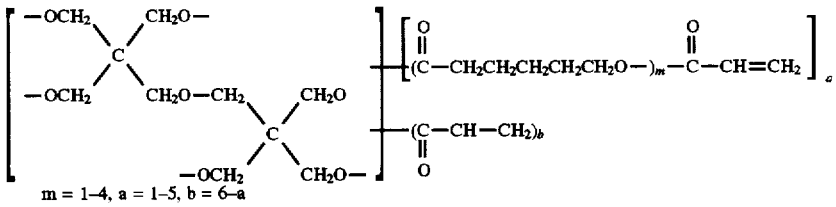

m = 1–4, a = 1–5, b = 6–a

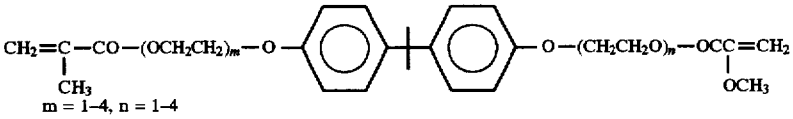

m = 1–4, n = 1–4

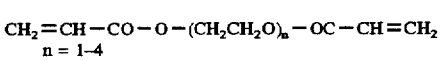

n = 1–4

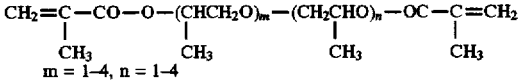

m = 1–4, n = 1–4

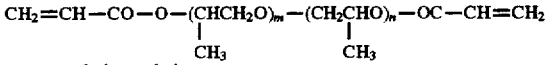

m = 1–4, n = 1–4

On the intermediate layer (i.e., cushioning layer), an image-receiving layer is placed. The image-receiving layer receives an image of ink material from the ink sheet, and per se transfers together with the image of ink material onto the final image support, leaving the intermediate layer on the support sheet of the image receiving sheet. The image-receiving layer transferred onto the final image support serves as a protective layer for protecting the transferred color image and further serves for imparting to the transferred final image appropriate luster similar to that of the actually printed material.

The image receiving layer preferably comprises a polyvinyl butyral resin or its derivative such as a cyclohexylisocyanate modified polyvinyl butyral resin. The polyvinyl butyral resin or its derivative can be employed in combination with a polymer having an amide group. The polymer having an amide group can have the recurring unit of the formula (1):

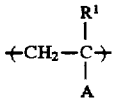

(1)

in which $R^1$ is hydrogen atom or methyl group, and A represents a substituent having an amide bonding group or a nitrogen atom-containing hetero rings.

The polymer of the formula (1) can be prepared from a compound of the formula (2) and, optionally, a copolymerizable monomer, in the presence or absence of a solvent and in the presence of a polymerization initiator according to the known processes.

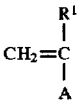

(2)

in which $R^1$ and A have the same meanings as in the formula (1).

The amide bonding group may be a group of —$CONHR^2$ or —$CONR^2R^3$ in which $R^2$ and $R^3$ independently represent hydrogen atom, an alkl group having carbon atoms of 1 to 18, or an aryl group having carbon atoms of 6 to 20. The alkyl group and aryl group may have one or more substituents such as hydroxyl group, an alkyl group having carbon atoms of 1 to 6, a halogen atom, and cyano group. $R^2$ and $R^3$ can be combined to form an alkylene group having carbon atoms of 1 to 20 or an aralkylene group. The alkylene group and aralkylene group may have a side chain, and bondings such as ether bonding, —OCO—, —COO—, and their combinations. The nitrogen atom-containing hetero ring may be a ring of imidazole, pyrrolidone, pyridine, or carbazole. The nitrogen atom-containing hetero ring may have one or more substituents such as an alkyl group having carbon atoms of 1 to 5, an aryl group having carbon atoms of 6 to 10, a halogen atom, and a cyano group.

Examples of the monomer having the formula (2) include (meth)acrylamide, N-alkyl(meth)acrylamide (in which "alkyl" may be methyl, ethyl, proypl, isopropyl, butyl, isobutyl, t-butyl, heptyl, octyl, ethylhexyl, cyclohexyl, or hydroxyethyl), N-aryl(meth)acrylamide (in which "aryl" may be phenyl, toll, nithenyl, naphthyl, or hydroxyphenyl), N,N-dialkyl(meth)acrylamide (in which "alkyl" may be methyl, ethyl, propyl, isopropyl, butyl, isobutyl, t-butyl, heptyl, octyl, ethylhexyl, cyclohexyl, or hydroxyethyl), N,N-diaryl(meth)acrylamide (in which "aryl" may be phenyl), N-methyl-N-phenyl(meth)acrylamide, N-hydroxyethyl-N-methyl(meth)acrylamide, N-2-acetamide, ethyl -N-acetyl (meth) acrylamide, N-

(phenylsulfonyl) (meth)-acrylamide, N-(p-methylphenylsulfonyl) (meth)acrylamide, 2-(or 3- or 4-)hydroxyphenylacrylamide, (meth)acryloylmorpholine, 1-vinylimidazole, 1-vinyl-2-methylimidazole, 1-vinyltriazole, 1-vinyl-3,5-dimethylimidazole, vinylpyrrolidone, 4-vinylpyridine, and vinylcarbazole.

The monomer of the formula (2) can be copolymerized with other monomers having a polymerizable double bond in the molecule such as (meth)acrylate ester, allyl compound, vinyl ether, vinyl ester, styrene, and crotonic ester.

Examples of the polymers having the recurring unit of the formula (1) include N,N-dimethylacrylamide/butyl (meth) acrylate copolymer, N,N-dimethyl (meth) acrylamide/2-ethylhexyl (meth)acrylate copolymer, N,N-dimethyl (meth) acrylamide/hexyl (meth)acrylate copolymer, N-butyl-(meth) acrylamide/butyl (meth) acrylate copolymer, N-butyl-(meth) acrylamide/2-ethylhexyl (meth)acrylate copolymer, N-butyl (meth) acrylamide/hexyl (meth) acrylate copolymer, (meth) acryloylmorpholine/butyl (meth) acrylate copolymer, (meth) acryloylmorpholine/2-ethylhexyl (meth)acrylate copolymer, (meth) acryloylmorpholine/hexyl (meth)acrylate copolymer, 1-vinylimidazole/butyl (meth) acrylate copolymer, 1-vinylimidazole/2-ethylhexyl (meth)acrylate copolymer, and 2-vinylimidazole/hexyl (meth)acrylate copolymer.

The polymer preferably has the recurring unit of the formula (1) in the range of 10 to 100 molar %, more preferably 30 to 80 molar %. The preferred molecular weight of the polymer is in the range of 1,000 to 200,000, more preferably 2,000 to 100,000.

The image-receiving layer may further contain other polymers, for instance, polyolefins such as polyethylene or polypropylene, ethylene copolymers such as ethylene/vinyl acetate copolymer, ethylene/acrylate ester copolymer, ethylene/acrylic acid copolymer, polyvinyl chloride, vinyl chloride copolymers such as vinyl chloride/vinyl acetate copolymer, polyvinylidene chloride, vinylidene chloride copolymer, polystyrene, styrene copolymers such as styrene/maleic acid ester copolymer, polyvinyl acetate, vinyl acetate copolymer, modified polyvinyl alcohol, polyamides such as copolymerized polyamide and N-alkoxymethylated polyamide, synthetic rubber, chlorinated ruler, phenol resin, epoxy resin, urethane resin, urea resin melamine resin, alkyd resin, maleic acid resin, hydroxystyrene copolymers, sulfonamide resin, ester gum, cellulose resin, and rosin.

The polymer having the recurring unit of the formula (1) may be incorporated into the image-receiving layer in an amount of less than 50 weight % (preferably less than 30 weight %) per the polymer composition of the image-receiving layer.

The image-receiving layer is formed on the intermediate layer by coating a solution of the material for the image-receiving layer on the intermediate layer. The solvent preferably is a solvent which does not dissolve the intermediate layer. For instance, if the intermediate layer comprises a vinyl chloride copolymer, the solvent for the preparation of the image-receiving layer preferably is an alcoholic solvent or an aqueous solvent.

The image-receiving layer preferably has a thickness in the range of 0.1 to 10 μm, more preferably 0.5 to 5 μm.

As is described hereinbefore, the image-receiving layer should be peeled off from the intermediate layer (i.e., cushioning layer) When the ink image is finally transferred onto the final image support. If desired, an auxiliary layer can be placed between the intermediate cushioning layer and the image-receiving layer.

The image formation kit and the image-receiving sheet of the invention is advantageously employed for the formation of a multi-color image which is composed of inks of three colors (cyan, magenta, and yellow) or of four colors (cyan, magenta, yellow, and black). The multi-color image can be produced using the image formation kit of the invention in the process which comprises the steps of:

1) placing an ink sheet which comprises a support sheet and an ink layer of 0.2 to 1.0 μm thick comprising 30 to 70 weight parts of a colored particulate pigment and 25 to 60 weight parts of an amorphous polymer having a softening point of 40° to 150° C. on an image-receiving sheet which comprises a support sheet, an intermediate layer comprising a polymer and a fluorine atom-containing anionic surfactant, to give an image forming composite comprising the ink sheet and the image-receiving sheet;

2) imagewise heating the image forming composite;

3) removing the support sheet of the ink sheet from the image-receiving sheet leaving an ink image on the image-receiving layer;

4) placing another ink sheet which comprises a support sheet and an ink layer of 0.2 to 1.0 μm thick comprising 30 to 70 weight parts of a colored particulate pigment of another color and 25 to 60 weight parts of an amorphous polymer having a softening point of 40° to 150° C. on the ink image left on the image-receiving layer in the step 3) above, to give another image forming composite;

5) imagewise heating the image forming composite given in the step 4) above;

6) removing the support sheet of the ink sheet from the image-receiving sheet leaving another ink image on the image-receiving layer;

7) repeating once or twice the steps 4) through 6) using one or two ink sheets having pigments of different colors, so as to form three or four ink images in total on the receiving layer of the receiving sheet;

8) combining the image-receiving sheet which has three or four ink images on its image-receiving sheet, with the final image support in such manner that the ink images of the image-receiving sheet are placed on the final image support; and 9) removing the support sheet of the image receiving sheet together with the intermediate layer from the final image support leaving both the image-receiving layer and the ink images on the final image sheet.

The heating of the ink sheet can be done using a heating head printer or a laser beam printer. If the laser beam printer is employed, the ink sheet preferably has a light-heat conversion layer between the support and the in layer so that the energy of the applied laser beam is efficiently converted into heat.

The present invention is further described in more detail by the following examples.

EXAMPLE 1

[Preparation of Ink Sheet]

The following three pigment dispersions were prepared:

| 1) Cyan pigment dispersion | |
|---|---|
| Cyan pigment (CI, P.B. 15:4) | 12 weight parts |
| Binder | 12 weight parts |
| Dispersing agent | 0.8 weight part |
| n-Propyl alcohol | 110 weight parts |

-continued

| | |
|---|---|
| 2) Magenta pigment dispersion | |
| Magenta pigment (CI, P.R.57:1) | 12 weight parts |
| Binder | 12 weight parts |
| Dispersing agent | 0.8 weight part |
| n-Propyl alcohol | 110 weight parts |
| 3) Yellow pigment dispersion | |
| Yellow pigment (CI, P.Y.14) | 12 weight parts |
| Binder | 12 weight parts |
| Dispersing agent | 0.8 weight part |
| n-Propyl alcohol | 110 weight parts |

Remarks:

Binder: polyvinyl butyral resin (Denka Butyral #2000-L, product of Denkai Kogyo Co., Ltd.)

Dispersing agent: Solsperse S-20000 (product of ICI Japan Co., Ltd.)

To 10 g of each pigment dispersion were added 0.24 g of stearylamide and 60 g of n-propyl alcohol to give a coating dispersion. Each of thus obtained coating dispersions was coated on a polyester film (thickness: 5 μm, available from Teijin Co., Ltd.) having been made easily releasable. Thus, a cyan ink sheet having a support and a cyan ink layer of 0.36 μm, a magenta ink sheet having a support and a magenta ink layer of 0.38 μm, and a yellow ink sheet having a support and a yellow ink layer of 0.42 μm were prepared.

[Preparation of Image Receiving Sheet]

An image receiving sheet having an image-receiving layer and an intermediate layer on a support was prepared as follows.

[Preparation of Intermediate Layer]

Composition of Coating Solution for Intermediate Layer

| | |
|---|---|
| Binder (vinyl chloride/vinyl acetate copolymer, MPR-TSL, product of Nisshin Chemicals Co., Ltd.) | 25 weight parts |
| Plasticizer (DPCA-120, product of Nippon Kayaku Co., Ltd., 6 functional acrylate monomer, M.W. 1947) | 12 weight parts |
| Fluorine atom-containing anionic surfactant (trade name: Megafac F-110, product of Dainippon Ink and Chemistry Industry, Co., Ltd., perfluoroalkylsulfonic acid sodium salt) | 0.4 weight part |
| Solvent (methyl ethyl ketone) | 75 weight parts |

The coating solution was coated on a polyethylene terephthalate (PET) film (thickness: 100 μm) using a whirler at a rotation rate of 300 r.p.m. The coated film was dried in an oven at 100° C. for 2 minutes. The dried intermediate layer had a thickness of 20 μm.

[Preparation of Image Receiving Layer]

Composition of Coating Solution for Image-Receiving Layer

| | |
|---|---|
| Binder (polyvinyl butyral, Denka Butyral, #2000-L) | 16 weight parts |
| Amide polymer (butyl acrylate/N,N-dimethylacrylamide = 31.6/24.4) | 4 weight parts |
| Fluorine atom-containing nonionic surfactant (trade name: Megafac F-177P, product of Dainippon Ink and Chemistry Industry, Co., Ltd.) | 0.5 weight part |
| Solvent (n-propyl alcohol) | 200 weight parts |

The coating solution was coated on the intermediate layer on the polyethylene terephthalate film using a whirler at a rotation rate of 200 r.p.m. The coated film was dried in an oven at 100° C. for 2 minutes. The dried image receiving layer had a thickness of 2 μm.

[Formation of Multi-Color Image]

Initially, the cyan ink sheet was superposed on the image receiving sheet, and a thermal head was placed on the cyan ink sheet side for imagewise forming a cyan image by the known divided sub-scanning method. The divided sub-scanning method was performed with multiple modulation for giving area gradation by moving a thermal head of 75 μm×50 μm in one direction at a pitch of 3 μm along 50 μm length. The support of the cyan ink sheet was then peeled off from the image receiving sheet on which a cyan image with area gradation was formed. On the image receiving sheet having the cyan image was superposed the magenta ink sheet, and the same procedure was repeated for placing a magenta image with area gradation on the image receiving sheet having the yellow image. The yellow ink sheet was then superposed on the image receiving sheet having the cyan and magenta images thereon in the same manner, and the same procedure was repeated for placing a yellow image with area gradation on the image receiving sheet. Thus, a multicolor image having area gradation was formed on the image receiving sheet.

Subsequently, an art paper sheet is placed on the image receiving sheet having the multicolor image and they were passed through a couple of heat rollers under the conditions of 130° C., 4.5 kg/cm and 4 m/sec. Then, the polyester film of the image receiving sheet together with the intermediate layer was peeled off, lead the multi-color image and the image-receiving layer on the art paper sheet. Quality of thus obtained multicolor image was high, and was on the same level as a chemical proof prepared from a lith-type film (Color Art, available from Fuji Photo Film Co., Ltd.).

The following is optical reflection density of a solid portion of each color image:

Cyan image: 1.54

Magenta image: 1.42

Yellow image: 1.57

The optical reflection density on characters of 4 point which was measured by means of a microdensitometer was almost the same as above. The gradation reproduction was observed in the range of 5% to 95%.

The adhesive strength between the intermediate layer and the image-receiving layer was measured. The measured value is set forth in Table 1. Also set forth in Table 1 is easiness of the transfer of the multi-color image from the image-receiving sheet to the final-image support (art paper)

EXAMPLE 2

The procedures for the preparation of image receiving sheet of Example 1 was repeated except for replacing the fluorine atom-containing anionic surfactant with another perfluoroalkylsulfonate (tradename: F-113, product of Dainippon Ink and Chemicals Industry Co., Ltd.).

The obtained image receiving sheet was employed in combination with the ink sheets of Example 1 to form a multi-color image on-an art paper in the same manner as in Example 1. Almost the same results were obtained in the multi-color image formation.

The adhesive strength between the intermediate layer and the image-receiving layer and easiness of the transfer are set forth in Table 1.

EXAMPLE 3

The procedures for the preparation of image receiving sheet of Example 1 was repeated except for replacing the fluorine atom-containing anionic surfactant with perfluoroalkylphoshate ester (tradename: F-191, product of Dainippon Ink and Chemicals Industry Co., Ltd.).

The obtained image receiving sheet was employed in combination with the ink sheets of Example 1 to form a multi-color image on an art paper in the same manner as in Example 1. Almost the same results were obtained in the multi-color image formation.

The adhesive strength between the intermediate layer and the image-receiving layer and easiness of the transfer are set fort in Table 1.

Comparison Example 1

The procedures for the preparation of image receiving sheet of Example 1 was repeated except for replacing the fluorine atom-containing anionic surfactant with a nonionic surfactant (tradename: NP-10, product of Nikko Chemicals, Co., Ltd.).

The obtained image receive sheet was employed in combination with the ink sheets of Example 1 to form a multi-color image on an art paper in the same mater as in Example 1.

The adhesive strength between the intermediate layer and the image-receiving layer and easiness of the transfer are set forth in Table 1.

Comparison Example 2

The procedures for the preparation of image receiving sheet of Example 1 was repeated except for replacing the fluorine atom-containing anionic surfactant with a fluorine atom-containing nonionic surfactant (perfluoroalkyl ethylene oxide adduct, tradename: F-142D, product of Dainippon Ink and Chemicals Co., Ltd.)

The obtained image receiving sheet was employed in combination with the ink sheets of Example 1 to form a multi-color image on an art paper in the same manner as in Example 1.

The adhesive strength between the intermediate layer and the image-receiving layer and easiness of the transfer are set forth in Table 1.

Comparison Example 3

The procedures for the preparation of image receiving sheet of Example 1 was repeated except for replacing the fluorine atom-containing anionic surfactant with a fluorine atom-containing cationic surfactant (perfluoroalkyl trimethyl ammonium salt, tradename, F-150, product of Dainippon Ink ad Chemicals Co., Ltd.).

The obtained image receiving sheet was employed in combination with the ink sheets of Example 1 to form a multi-color image on an art paper in the same manner as in Example 1.

The adhesive strength between the intermediate layer and the image-receiving layer and easiness of the transfer are set forth in Table 1.

Comparison Example 4

The procedures for the preparation of image receiving sheet of Example 1 was repeated except for replacing the fluorine atom-containing anionic surfactant with a fluorine atom-containing nonionic surfactant (tradename, Fluorard FC-430, product of 3M Corporation).

The obtained image receiving sheet was employed in combination with the ink sheets of Example 1 to form a multi-color image on an art paper in the same manner as in Example 1.

The adhesive strength between the intermediate layer and the image-receiving layer and easiness of the transfer are set forth in Table 1.

Comparison Example 5

The procedures for the preparation of image receiving sheet of Example 1 was repeated except for not using the fluorine atom-containing anionic surfactant from the intermediate layer.

The obtained image receiving sheet was employed in combination with the ink sheets of Example 1 to form a multi-color image on an art paper in the same manner as in Example 1.

The adhesive strength between the intermediate layer and the image-receiving layer and easiness of the transfer are set forth in Table 1.

TABLE 1

| Example | Surfactant | Adhesive Strength | Transfer of Color Image |
|---|---|---|---|
| Ex. 1 | Perfluoroalkyl sulfonate I | 5.0 g/cm | Smooth |
| Ex. 2 | Perfluoroalkyl sulfonate II | 6.0 g/cm | Smooth |
| Ex. 3 | Perfluoroalkyl phosphate | 50.0 g/cm | Smooth |
| Com. Ex. 1 | Nonionic surfactant | over 2 kg/cm | Difficult |
| Com. Ex. 2 | Perfluoroalkyl ethylene oxide | over 2 kg/cm | Not uniform |
| Com. Ex. 3 | Perfluoroalkyl trimethylammonium | over 2 kg/cm | Not uniform |
| Com. Ex. 4 | Fluorine-containing nonionic surfactant | 20 g/cm | Transfer of Inter-layer |
| Com. Ex. 5 | None | over 2 kg/cm | Difficult |

Remark:
In Comparison Example 4, the intermediate layer was left together the image-receiving layer and the multi-color ink image on the art paper (i.e., final image support) when the image receiving sheet was peeled off from the art paper.

What is claimed is:

1. An image forming kit comprising an ink sheet and an image receiving sheet, wherein the ink sheet comprises a support sheet and an ink layer of 0.2 to 1.0 μm thick comprising 30 to 70 weight parts of a particulate pigment and 25 to 60 weight parts of an amorphous polymer having a softening point of 40° to 150° C., and the image receiving sheet comprises a support sheet, an intermediate layer and an image-receiving layer, said intermediate layer comprising a polymer and a fluorine atom-containing anionic surfactant.

2. The image forming kit of claim 1, wherein the amorphous polymer of the ink layer is polyvinyl butyal.

3. The image forming kit of claim 1, wherein the ink layer has a thickness of 0.2 to 0.8 μm.

4. The image forming kit of claim 1, wherein the polymer of the intermediate layer is a vinyl chloride/vinyl acetate copolymer, a vinyl chloride/vinyl alcohol copolymer, a vinyl chloride/vinyl acetate/maleic acid copolymer, a vinyl chloride/vinyl acetate/vinyl alcohol copolymer, or a vinyl chloride/vinyl acetate/hydroxyalkyl acrylate.

5. The image forming kit of claim 1, wherein the fluorine atom-containing anionic surfactant is a perfluoroalkylsulfonate, a perfluoroalkylphoshate, a perfluoroalkylcarboxylate, a perfluoroalkylaminosulfonate, or an ester thereof.

6. The image forming kit of claim 1, wherein the image-receiving layer of the image receiving sheet comprises the same amorphous polymer or its derivative as the amorphous polymer of the ink layer of the ink sheet.

7. The image forming kit of claim 1, wherein the image-receiving layer of the image receiving sheet comprises polyvinyl butyral or its derivative.

8. The image forming kit of claim 1, which comprises at least three sets of the ink sheets, the pigments of which have colors of cyan, magenta and yellow, respectively.

9. The image forming kit of claim 8, which further comprises the ink sheet having a black pigment.

10. A process for preparing a multi-color image on a final image support sheet which comprises the steps of:

1) placing an ink sheet which comprises a support sheet and an ink layer of 0.2 to 1.0 μm thick comprising 30 to 70 weight parts of a colored particulate pigment and 25 to 60 weight parts of an amorphous polymer having a softening point of 40° to 150° C. on an image receiving sheet which comprises a support sheet, an intermediate layer comprising a polymer and a fluorine atom-containing anionic surfactant, to give an image forming composite comprising the ink sheet and the image receiving sheet;

2) imagewise heating the image forming composite;

3) removing the support sheet of the ink sheet form the image receiving sheet leaving an ink image on the image-receiving layer;

4) placing another ink sheet which comprises a support sheet and an ink layer of 0.2 to 1.0 μm thick comprising 30 to 70 weight parts of a colored particulate pigment of another color and 25 to 60 weight parts of an amorphous polymer having a softening point of 40° to 150° C. on the ink image left on the image-receiving layer in the step 3) above, to give another image forming composite;

5) imagewise heating the image forming composite given in the step 4) above;

6) removing the support sheet of the ink sheet from the image receiving sheet leaving another ink image on the image-receiving layer;

7) repeating once or twice the steps 4) through 6) using one or two ink sheets having pigments of different colors, so as to form three or four ink images in total on the receiving layer of the receiving sheet;

8) combining the image receiving sheet which has three or four ink images on its image receiving sheet, with the final image support in such manner that the ink images of the image receiving sheet are placed on the final image support; and 9) removing the support sheet of the image receiving sheet together with the intermediate layer from the final image support leaving both the image-receiving layer and the ink images on the final image sheet.

* * * * *